US006324807B1

(12) United States Patent
Ishiko

(10) Patent No.: US 6,324,807 B1
(45) Date of Patent: Dec. 4, 2001

(54) METHOD OF ATTACHING SIDING BOARDS AND SIDING BOARD ATTACHMENT STRUCTURE

(75) Inventor: Takuo Ishiko, Aichi (JP)

(73) Assignee: Nichiha Corporation, Aichi (JP)

( * ) Notice: Subject to any disclaimer, the term of this patent is extended or adjusted under 35 U.S.C. 154(b) by 0 days.

(21) Appl. No.: 09/362,096

(22) Filed: Jul. 28, 1999

(30) Foreign Application Priority Data

Jul. 29, 1998 (JP) ..... 10-213792

(51) Int. Cl.[7] ..... E04B 2/00

(52) U.S. Cl. ..... 52/506.01; 52/506.05; 52/543; 52/712

(58) Field of Search ..... 52/506.01, 506.05, 52/543, 546, 712; 211/84.01, 162

(56) References Cited

U.S. PATENT DOCUMENTS

| | | | | |
|---|---|---|---|---|
| Re. 21,278 | * | 11/1939 | Willson | 52/506.05 X |
| 5,144,786 | * | 9/1992 | Pacione | 52/747 |
| 5,224,610 | * | 7/1993 | Veazey | 211/87 |
| 5,398,473 | * | 3/1995 | Chan | 52/506.05 X |
| 5,791,093 | * | 8/1998 | Diamond | 52/506.01 X |
| 6,098,364 | * | 8/2000 | Liu | 52/506.05 X |

FOREIGN PATENT DOCUMENTS

| | | | |
|---|---|---|---|
| 2-252849 | 10/1990 | (JP) . | |
| 4-23745 | 2/1992 | (JP) . | |
| 4-122101 | 11/1992 | (JP) . | |
| 7-229268 | 8/1995 | (JP) . | |
| 8-13700 * | 8/1996 | (JP) | E04D/1/30 |

OTHER PUBLICATIONS (1) English Language Abstract of JP 2–252849.
(2) English Language Abstract of JP 2–229268.

* cited by examiner

*Primary Examiner*—Bruce A. Lev
(74) *Attorney, Agent, or Firm*—Lowe Hauptman Gilman & Berner, LLP

(57) ABSTRACT

A siding board attachment structure comprising a number of suspenders each having a hook portion and fixed to a building frame, and siding boards each provided on the back surface thereof with an engaging groove which is engaged with the hook portion of each of the suspenders, whereby the siding boards are maintained in a stably suspended state. The siding boards of neighboring stages can be suitably spaced apart to such an extent that sidewall surfaces of upper and lower siding boards are made visible.

11 Claims, 10 Drawing Sheets

METHOD OF ATTACHING SIDING BOARDS AND SIDING BOARD ATTACHMENT STRUCTURE

BACKGROUND OF THE INVENTION

The present invention relates to a method of attaching siding boards, and to a siding board attachment structure.

There are conventionally two known methods for attaching siding boards such as natural stone boards or ceramic board onto the wall of building, i.e. a so-called wet working method wherein siding boards are fixedly attached to a building frame by means of an embedding mortar or adhesive, and a so-called dry working method wherein siding boards are fastened to a building frame using a screw or a fastening member. The wet working method is advantageous in stabilizing the attachment of siding boards to a building frame, however, it takes a long time to completely cure the mortar or adhesive, frequently requiring a long working period. On the other hand, the dry working method is advantageous in that the fastening work is relatively simple and the working period is relatively short. However, if a screw is to be employed for fastening siding boards to a building frame, the head portion of screw is required to be hidden, while if a fastening member is to be employed for fastening siding boards to a building frame, the resultant structure may not be sufficiently aseismatic because the fastening of the siding board is effected by simply resting the siding board on the supporting portion of the fastening member.

There is also known, as a more improved fastening member, a structure as shown in FIG. 9 wherein a fastening member 50 is provided with an engagement portion 51 consisting of an upwardly inclined hook 52 and a downwardly inclined hook 53. In this case, the fastening member 50 is secured to a building frame 56 with a screw or a nail 55 while the downwardly inclined hook 53 engages with the top edge portion of a male portion 61A of a lower siding board 60A which has been attached in advance to the building frame 56. Thereafter, the groove portion (female portion) 61B formed at the lower fringe or edge of an upper siding board 60B is placed to engage the upwardly inclined hook 52, thus fastening the upper and lower siding boards 60A and 60B successively.

According to the siding board attachment structure using a fastening member having the aforementioned structure, since the upper fringe portion and the lower fringe portion of the siding board are placed to engage the downwardly inclined hook 53 and the upwardly inclined hook 52, respectively, the resultant structure exhibits a relatively high stability against a seismic vibration. However, since the upper siding board 60B is fastened in such a manner that the dead weight of the upper siding board 60B is supported by the upwardly inclined hook 52; it cannot therefore be said that the resultant siding board attachment structure is sufficiently stabile. Further, since siding boards are to be fastened while being rested on the upwardly inclined hooks 52, the actual attachment work is required to be performed in such a manner as to keep both upper and lower siding boards sustained horizontally (otherwise, the dislocation due to slipping may be easily caused, thus making it difficult to perform the siding work). As a result, the overall shape of the siding board is limited to a square configuration, and the attaching direction is also restricted, thus inevitably restricting the design of the resultant wall structure as a whole (for example, a monotonic square pattern such as a brick work pattern or a tile work pattern). Therefore, it is difficult to realize a siding work which is rich in design.

Furthermore, in order to hide the inclined hooks 52 and 53 of the fastening member, the lower and upper fringe portions of the siding board are required to be worked to have a special configuration as shown in FIG. 9.

In recent years, the kinds of siding board have become diversified. For example, a highly creative siding board 60 which is relatively small and thick (e.g. 35 mm×220 mm×455 mm) and provides a feeling of natural stone masonry as shown in FIG. 10 is now increasingly commercialized. The fastening of this kind of siding board is usually effected using a fastening member as shown in FIG. 9. Therefore, at least the upper and lower fringe portions of the siding board are required to be provided with a groove 63 which is adapted to be engaged with the downwardly inclined hook 53 and with the upwardly inclined hook 52.

When the siding boards of this kind which are relatively thick and rich in creativity as mentioned above are to be fastened to a building frame by arraying them in a multistage pattern extending in the vertical direction, it is generally desirable to fasten the siding boards in such a manner as to leave a horizontal joint, i.e. a space of some degree between the upper fringe and the lower fringe of the vertically neighboring siding boards, thus making the space visible conspicuously to the eyes and hence providing the resultant structure with a voluminous feeling.

However, it is difficult, if such siding boards are to be fastened using the fastening member 50 having the aforementioned structure, to perform the siding work while leaving such a deep space between the upper fringe and the lower fringe of the vertically neighboring siding boards. Even if it is possible to leave a sufficient space between the upper fringe and the lower fringe of the neighboring siding boards, the hooks 52 and 53 as well as the groove 63 that has been formed in the siding board 60 may be made externally visible, thus yielding an unsightly external appearance and hence failing to obtain a good design.

BRIEF SUMMARY OF THE INVENTION

The present invention overcomes the aforementioned problems accompanied with the conventional method of attaching siding boards or with the conventional siding board attachment structure.

Therefore, an object of the present invention is to provide a novel method of attaching siding boards as well as a novel siding board attachment structure. More specifically, an object of the present invention is to provide a method of attaching siding boards to obtain a siding board attachment structure exhibiting an increased fastening strength as well as an increased aseismatic property even if a fastening member is employed in the siding method.

Another object of the present invention is to provide a method of attaching siding boards and a siding board attachment structure, which are capable of providing a high degree of freedom in the shape of the siding board as well as in the direction of attaching the siding board, thus making it possible to construct a wall surface being rich in design as compared with the conventional wall surface, and at the same time, to simplify the attachment work of siding boards as compared with the conventional attachment work of siding boards.

A further object of the present invention is to provide a method of attaching siding boards and a siding board attachment structure, which renders a relatively thick sidewall of the siding board visible, thereby making it possible to easily obtain a siding board attachment structure of enhanced design quality.

In order to achieve the aforementioned objects, the present invention provides a method of attaching siding boards to a building frame which comprises the steps of; fixing a suspender to said building frame, said suspender having a hook portion; and attaching a siding board provided with an engaging groove to said suspender by permitting said engaging groove of siding board to be engaged with said hook portion of suspender, thereby attaching siding boards to the building frame while maintaining the siding boards in a suspended state.

The present invention also provides, in order to achieve the aforementioned objects, a siding board attachment structure which comprises; a large number of suspenders each having a hook portion and fixed to a building frame; and siding boards each provided on the back surface thereof with an engaging groove which is engaged with said hook portion of the suspender, thereby rendering said siding boards to be maintained in a suspended state.

According to a preferable embodiment of the present invention, the siding board attachment structure is constructed such that the siding boards are attached in a suspended state and in a multi-stage pattern to the building frame wherein the siding boards of neighboring stages are spaced apart to such an extent that sidewall surfaces of upper and lower siding boards are made visible.

According to the method of attaching siding boards and siding board attachment structure of the present invention, the attachment of siding boards to a building frame is effected not by resting the siding boards on a fastening member as in the case of the conventional method, but by allowing the siding board to be suspended by the dead weight thereof through an engagement of the engaging groove formed on the back surface of the siding board with the hook portion of the suspender, so that the attached state of the siding boards can be extremely stabilized and hence the siding boards tend not to fall away from a building frame even if the siding boards are caused to vibrate due to an earthquake, etc.

Further, since the attachment of siding boards is effected through the hanging of the siding boards on the suspender, the siding boards can be attached to a building frame in any desired manner as long as an engaging groove for the suspension is horizontally formed on the back surface of each siding board. For example, a siding board can be attached to a building frame independent of neighboring siding boards. Therefore, it is possible to give a high degree of freedom to the external shape and arrangement (directivity) of siding boards, and hence the design or pattern of the siding boards that can be obtained would not be restricted to a monotonic square pattern such as a brick work pattern or a tile work pattern. Namely, a wall surface, an external corner or a reentrant angle portion, which are all rich in design can be easily constructed. Furthermore, it becomes also easy to attach the siding boards to a building frame, leaving a space of any desired width (horizontal joint) between an upper and lower siding boards, thus permitting the sidewall surface of the siding board to become visible to present a resultant wall surface which appears heavy and thick, thereby making it possible to easily obtain a siding board attachment structure of enhanced design quality.

Additionally, since the attachment of siding boards is effected through the suspension of the siding boards and a siding board can be attached to a building frame independent of neighboring siding boards, each siding board can be easily attached to or detached from a building frame, so that when a siding board is damaged, only the damaged siding board is required to be removed and replaced by a new siding board.

Since the engaging groove for the suspension of the siding board is required to be formed only on the back surface of the siding board, the groove-forming work for forming an engaging groove on the four sides or cross-sections of siding board is no longer required. Therefore, any desired design (pattern) can be applied to all of cross-sections of siding board, thereby making it possible to easily represent the horizontal joint with a high-grade feeling.

The attachment work of siding boards to a building frame may be performed after the suspender is provisionally attached to the siding board, the suspender provisionally attached to the siding boards being subsequently fixed to a building frame while adjusting the position of the siding board. Alternatively, the attachment work of siding boards to a building frame may be performed after the suspender is fixed in advance to the building frame, the siding boards being subsequently successively hung on the suspender. If a siding board of large size is to be attached to a building frame by making use of a plurality of suspenders, all of the suspenders may be provisionally attached to the siding board, and after one of the suspenders is fixed to the building frame while adjusting the position of siding board to thus position the siding board in place, the remaining suspenders are finally fixed to the building frame.

DETAILED DESCRIPTION OF THE INVENTION

The present invention will be further explained with reference to the drawings depicting preferable embodiments of the present invention.

Figure 1:
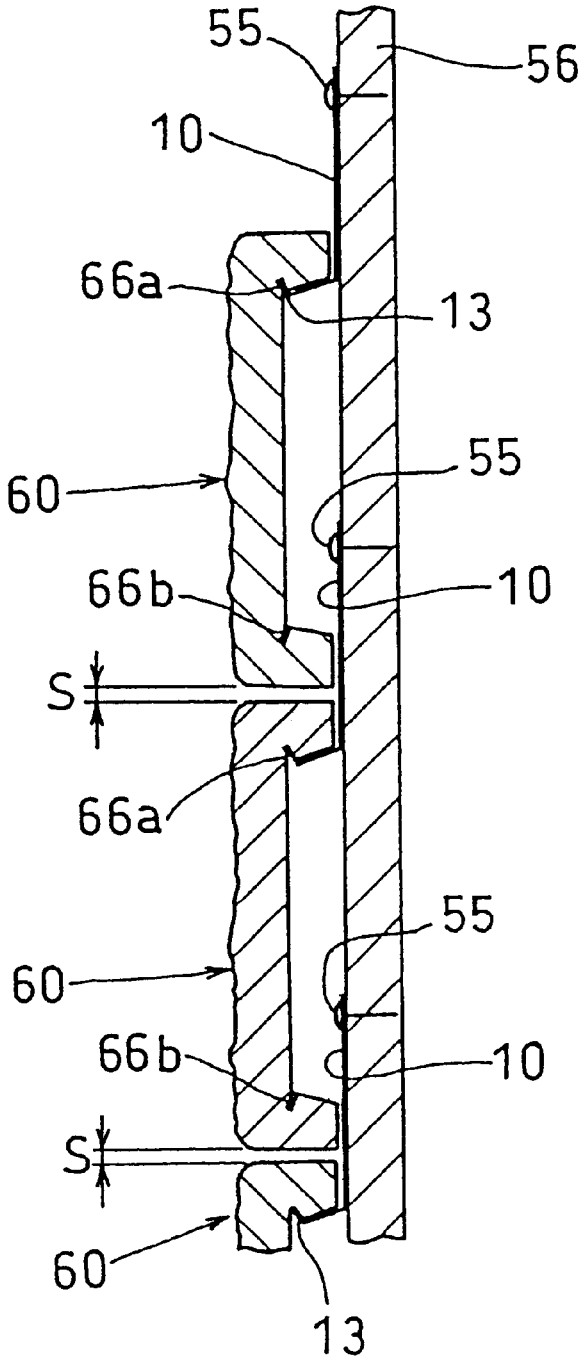
FIG. 1 is a cross-sectional view illustrating one embodiment of a siding board attachment structure constructed by a method of attaching siding boards according to the present invention.
Figure 4A:
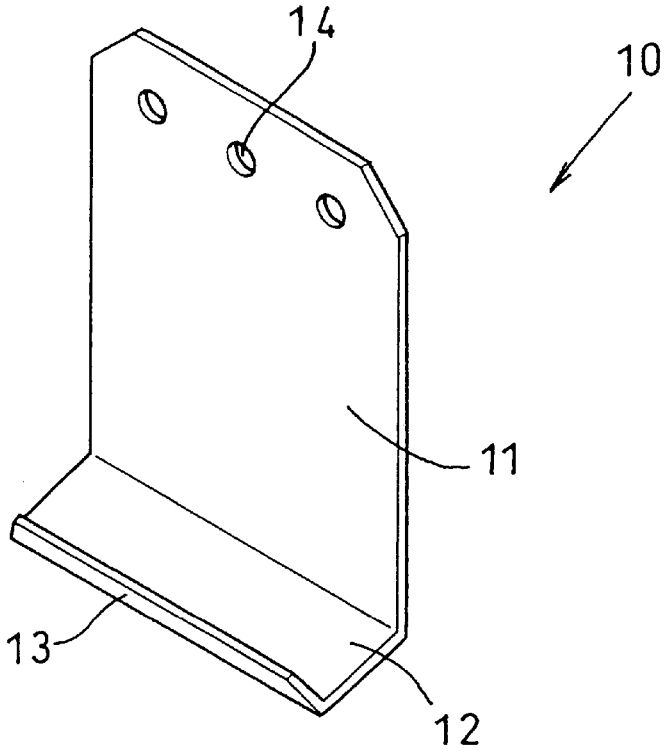
FIGS. 4A and 4B are perspective views each illustrating a different embodiment of a suspender to be employed in a method of attaching siding boards according to the present invention.
Figure 4B:
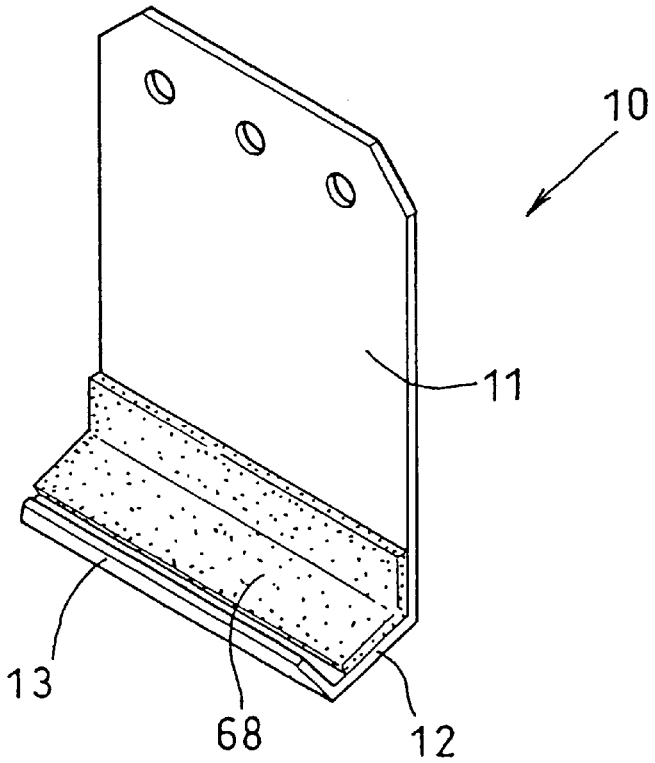
Figure 5:
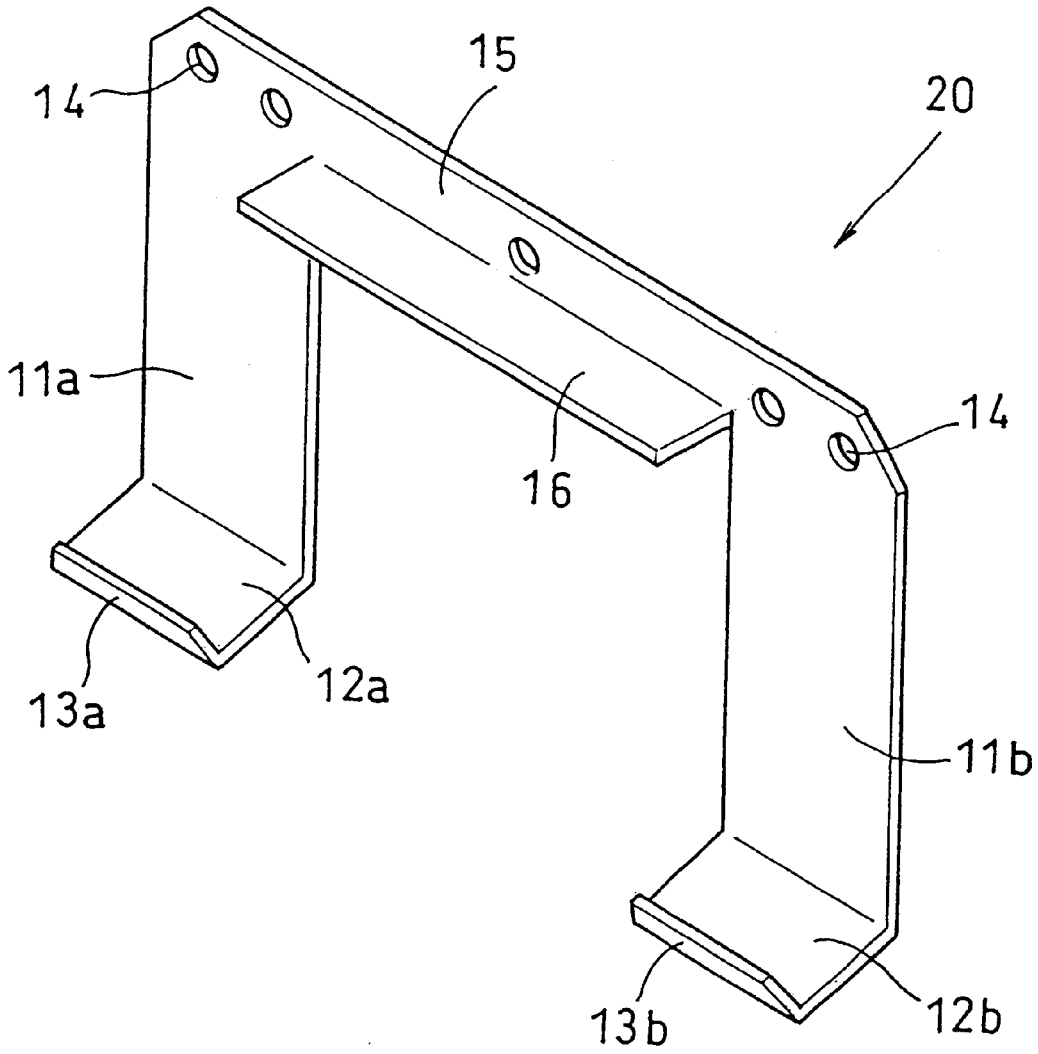
FIG. 5 is a perspective view illustrating another embodiment of suspender according to the present invention.

FIG. 1 is a cross-sectional view illustrating one embodiment of a siding board attachment structure which has been constructed by a method of attaching siding boards according to the present invention. FIGS. 2A, 2B, 3A and 3B show various embodiments of the siding board to be employed in the present invention. FIGS. 4A, 4B and 5 show various embodiments of a suspender to be employed in a method of attaching siding boards according to the present invention.

Figure 2A:
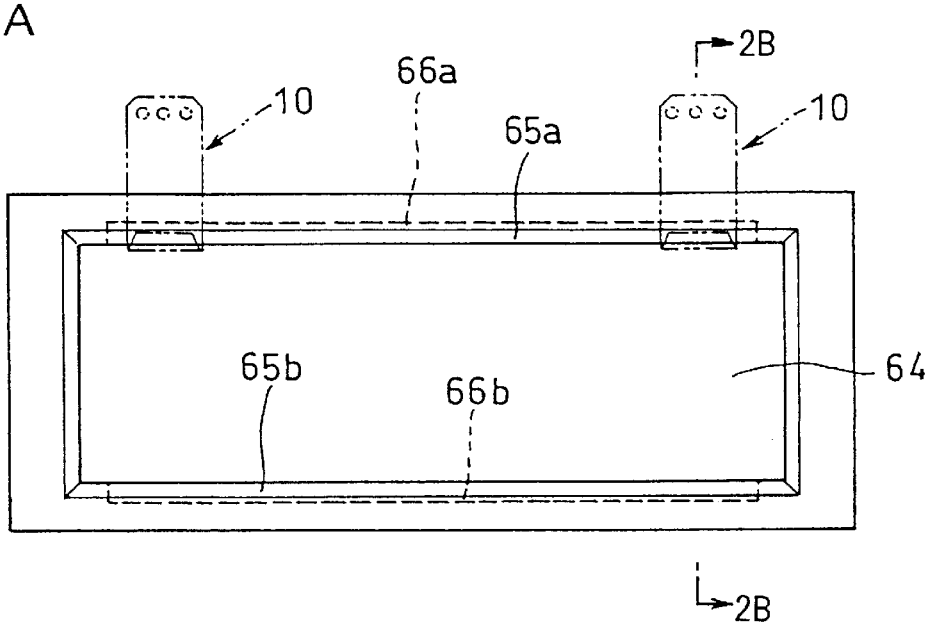
FIG. 2A is a plan view illustrating the back surface of a siding board to be employed in a method of attaching siding boards according to the present invention.
Figure 2B:
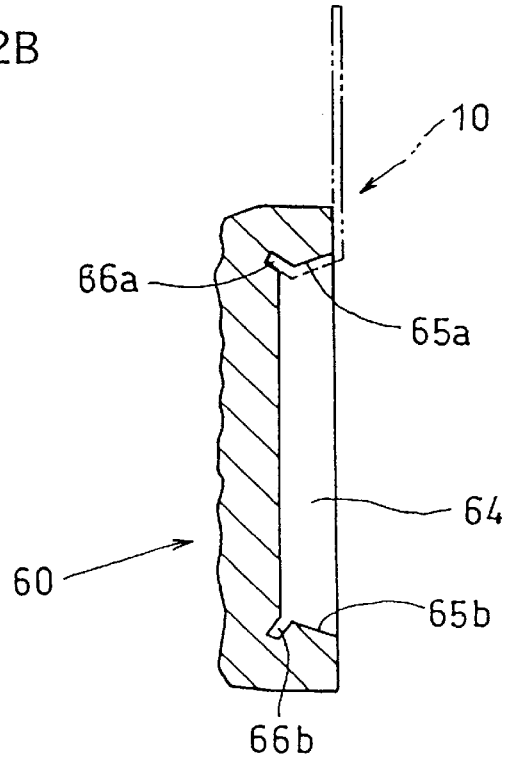
FIG. 2B is a cross-sectional view taken along the line 2B—2B of FIG. 2A.
Figure 10:
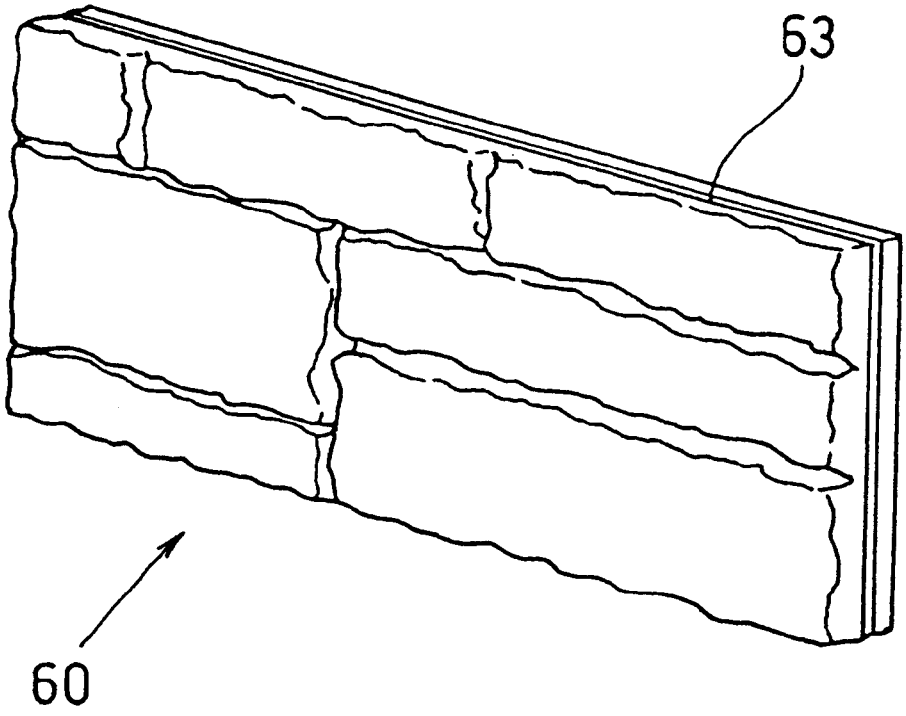
FIG. 10 is a perspective view illustrating one embodiment of a siding board.

Referring to these FIGS., a siding board 60 is formed, for example, of a square configuration having a block-stacked pattern whose surface represents natural stone masonry as shown in FIG. 10. Further, as shown in FIGS. 2A and 2B, the back surface of the siding board 60 is generally flat and provided with a rectangular recessed portion 64. The bottom edge portions of the upper side wall 65*a* and lower side wall 65*b* of the recessed portion 64 are further deeply cut thereby forming engaging grooves 66*a* and 66*b* into which the hook portion 13 of a suspender 10 to be illustrated hereinafter can be inserted. These engaging grooves 66*a* and 66*b* are formed extending along approximately the entire length of the bottom edge portions of the upper side wall 65*a* and lower side wall 65*b*, respectively. The attachment of the siding board 60 to the building frame can be executed even if either one of these engaging grooves 66*a* and 66*b* is omitted. However, the provision of this engaging groove at both bottom edge portions of the upper side wall 65*a* and lower side wall 65*b* of the recessed portion 64 as illustrated in this embodiment is desirable for facilitating workability (namely, the direction of attaching the siding board 60 can be freely selected).

The suspender 10 to be employed for the attachment of the siding board 60 having the aforementioned structure is formed of a suitable metal plate. For example, in the case of the embodiment shown in FIG. 4A, the suspender 10 comprises a substrate 11, a bottom plate 12 extending forward from the lower end of the substrate 11, and a hook portion 13 extending obliquely upward from the distal end of the bottom plate 12. Through-holes 14 are formed in the substrate 11 for permitting a screw or nail 55 to be inserted therethrough for fixing the suspender 10 to a building frame 56.

As shown in FIG. 1, the extending length and inclined angle of the bottom plate 12 are designed to approximately correspond to the width (in the depthwise direction) and angle of the upper side wall 65*a* (or the lower side wall 65*b*) of the recessed portion 64 formed on the back surface of the siding board 60. Further, the extending length and inclined angle of the hook portion 13 are designed such that the hook portion 13 can be stably fitted in the engaging grooves 66*a* and 66*b* formed on the back surface of the siding board 60. Further, for the purpose of facilitating the insertion of the hook portion 13 into the engaging grooves 66*a* and 66*b*, both side portions of the hook portion 13 are tapered.

The attachment of siding boards 60 to the building frame 56 can be performed as follows, for example. First, a desired number of suspenders 10 are fixed by means of nails 55 to the building frame 56 to thereby form a row of suspenders 10 with a predetermined interval between neighboring suspenders 10. Then, as shown by a phantom line in FIGS. 2A and 2B, each siding board 60 is suspended by a couple of suspenders 10 thereby realizing a stable attachment of the siding board 60 to the building frame 56. The interval between neighboring suspenders 10 is adjusted so as to render the side faces of laterally neighboring siding boards 60 to become closely contacted with each other.

In this manner, a desired number of the siding boards 60 are successively hung on the suspenders 10 which have been fixed in advance to the building frame thereby forming a row of the siding boards 60 extending in the lateral direction. In this case, a suitable adhesive may be preferably coated on the back surface of each siding board 60 so as to adhere the siding boards 60 to the building frame, thereby achieving more stabilized attachment of the siding boards 60 to the building frame. Then, the fixing of another set of suspenders to the building frame is performed for the attachment of siding boards 60 of an upper stage (level). In this case, if required, the positioning of the suspender 10 is determined taking the space "S" of the horizontal joint into consideration. The aforementioned siding work is repeated until the attachment of a required number of rows of siding boards is accomplished.

Although not shown in the drawings, the suspenders 10 may be provisionally attached to the back surface of the siding board 60, and then the suspenders 10, each provisionally attached to the siding board 60, are fixed to the building frame 56 while adjusting the position of each siding board 60. This latter method is especially advantageous if siding boards of large size are to be attached to a building frame, since the adjustment in position of siding board 60 can be easily performed.

Since the attachment of siding boards 60 to a building frame is effected by allowing the siding board 60 to be suspended due to the dead weight thereof through an engagement of the engaging groove 66*a* formed on the back surface of the siding board 60 with the hook portion 13 of the suspender 10, the attached state of the siding boards 60 is extremely stable and hence the siding boards 60 tend not to fall away from the building frame even if the siding boards 60 are caused to vibrate due to an earthquake, etc.

Furthermore, since the siding boards 60 can be attached to a building frame, leaving a space "S" of any desired width (horizontal joint) between the upper and lower siding boards 60, the sidewall surface of the siding board 60 is made visible, thus providing a resultant wall surface that exhibits a thickened look and feel. Additionally, since the siding boards 60 can be freely designed with respect to the external configuration and orientation thereof, it is possible to apply them to the construction of a wall surface which is not restricted to a monotonic square pattern such as a brick work pattern or a tile work pattern, but rather, includes various pattern which are rich in design.

Figure 3A:
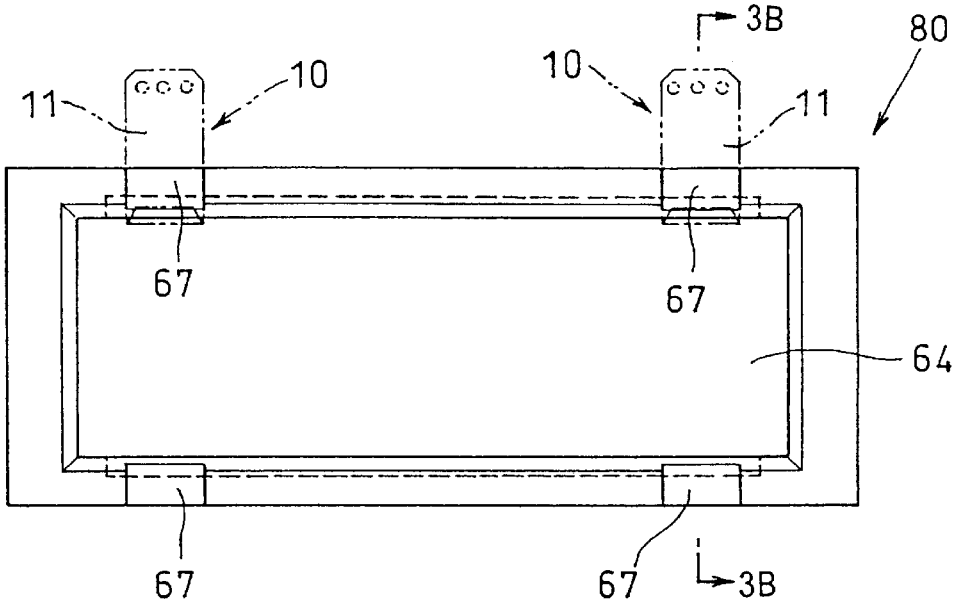
FIG. 3A is a plan view illustrating the back surface of a siding board according to another embodiment of the present invention.
Figure 3B:
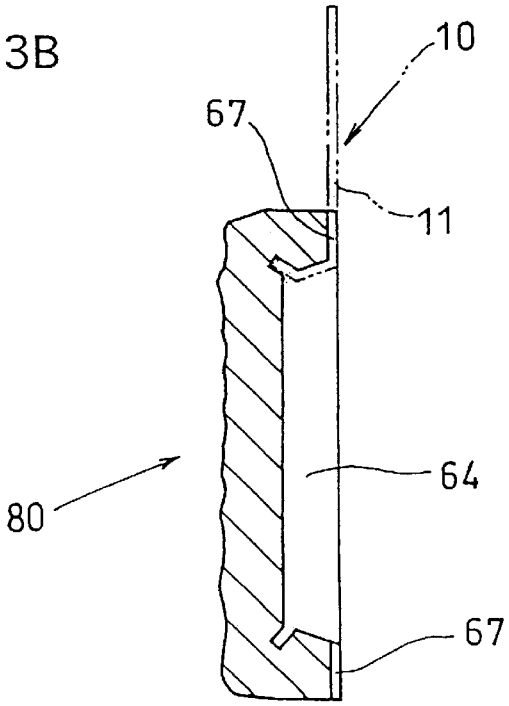
FIG. 3B is a cross-sectional view taken along the line 3B—2B of FIG. 3A.

FIGS. 3A and 3B illustrate a siding board 80, which is a modified example of the siding board 60. In this embodiment, predetermined portions of the back surface of the siding board 80, which are to be contacted with the substrate 11 of the suspender 10, are cut away thereby recess or cut portions 67 for receiving a portion of substrate 11 therein, as illustrated in FIGS. 3A and 3B. As a result, the back surface of the siding board 80 can be attached flush against the building frame because substrate 11 of the suspender 10 is received within recess 67. This modified siding board 80 is useful in the case where the thickness of the suspender 10 cannot be disregarded in view of carrying out the siding work. This modified siding board 80 is also advantageous, in the case where an adhesive is employed, in stabilizing the adhesion of the siding board 80 to the building frame.

FIG. 4B illustrates a modified example of the suspender 10. In this embodiment, an elastic material 68 such as a sponge is adhered to a portion of the suspender 10 against which the siding board 60 is to be impinged when the siding board 60 is hung by means of the suspender 10. This modified suspender 10 is effective in stabilizing the anchorage between the siding board 60 and the suspender 10, and at the same time, in preventing the siding board 60 from being inadvertently damaged.

FIG. 5 illustrates another modified example of the suspender. This suspender 20 is constructed such that a couple of suspenders 10 shown in FIGS. 4A and 4B are integrally connected with each other (it is also possible to combine three or more suspenders 10). Specifically, right and left substrates 11*a* and 11*b* are integrally attached to both sides of a horizontal member 15, and bottom plates 12*a* and 12*b* as well as hook portions 13*a* and 13*b* are extended from these right and left substrates 11*a* and 11*b*, respectively. Through-holes 14 are formed not only in the horizontal member 15 but also in the right and left substrates 11*a* and 11*b*. In this embodiment, a bent portion 16 which is bent horizontally and extended in the same direction as that of the substrates 11*a* and 11*b* is also integrally attached to the horizontal member 15.

Figure 6:
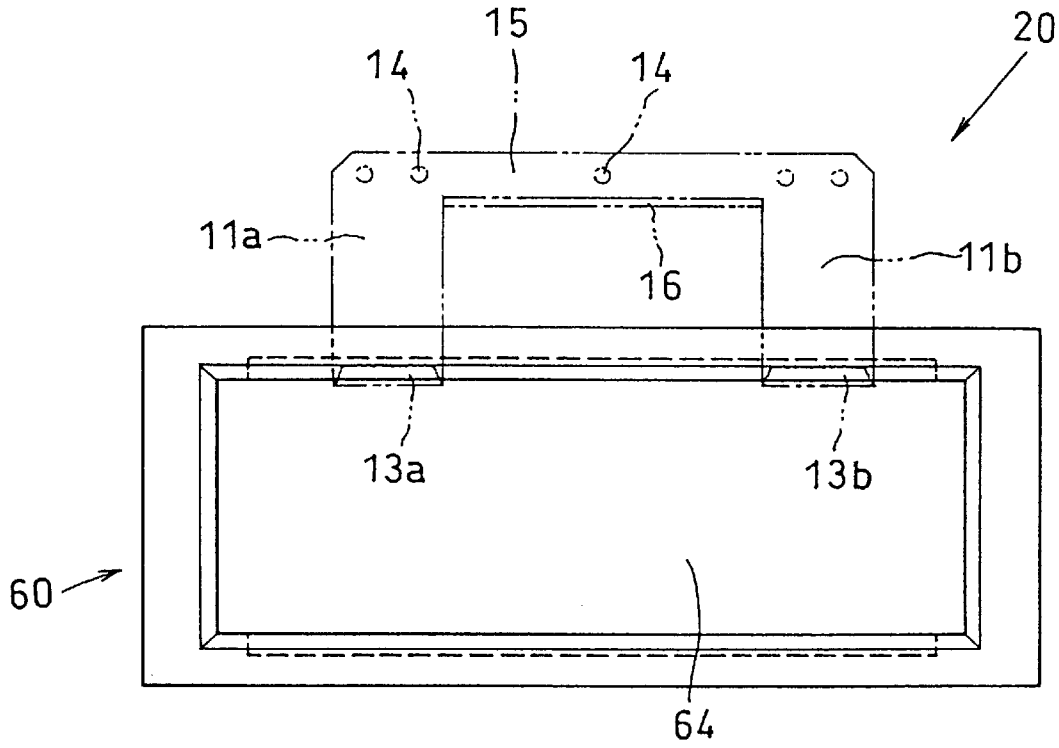
FIG. 6 is a plan view illustrating a manner of using the suspender shown in FIG. 5.

FIG. 6 illustrates a state where the siding board 60 is attached to a building frame by making use of the aforementioned suspender 20. As shown in FIG. 6, the siding board 60 can be sustained by two points thereof by making use of only one suspender 20. Therefore, a predetermined number of siding boards can be attached using a smaller number of suspenders, thereby making it possible to simplify the fixing work of the suspenders to a building frame. Further, since this suspender is provided at the horizontal member with the bent portion 16, this bent portion 16 can be utilized as gripping means for easily moving the siding board while keeping the siding board hung on this suspender. Therefore, this suspender 20 is convenient while attaching the siding board 60 to a building frame because it allows for adjusting the horizontal or vertical positioning of the siding board 60 while allowing the siding board 60 to be provisionally mounted on the suspender 20. The size and position of this bent portion 16 should be such that it can be entirely accommodated within the recessed portion 64 and in spaced relation to the sidewalls of the siding board 60 (not seen in FIG. 6) to be attached adjacent side board 60 in FIG. 6 at the next upper position to avoid obstructing the attachment of the adjacent side board.

Figure 7:
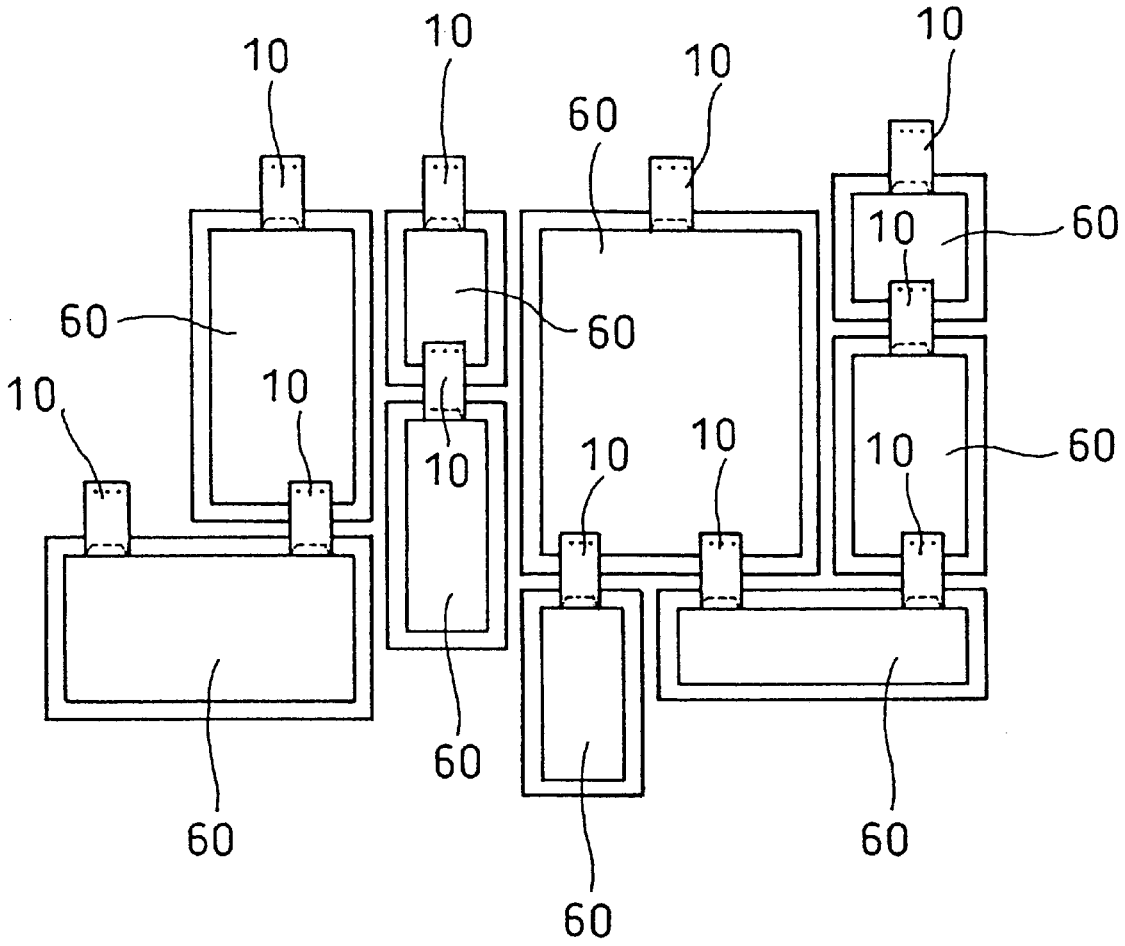
FIG. 7 is a rear view schematically illustrating one embodiment of a building wall that has been constructed by a method of attaching siding boards according to the present invention.

FIG. 7 illustrates a schematic view of the back surface of a building wall which has been constructed using a method of attaching siding boards according to the present invention. As shown in FIG. 7, a large number of siding boards 60 varied in size are attached to a building frame while being hung on the suspenders 10 which have been fixed to the building frame. As mentioned above, since it is possible, according to the method of the present invention for attaching siding boards to a building frame, to independently execute the attachment of each siding board from neighboring siding boards, a siding board of any desired size can be easily attached to the building frame in any desired state as long as a place for horizontally fixing the suspender 10 can be secured in the building frame. As a result, it is now possible to construct a building wall which is rich in design.

Figure 8:
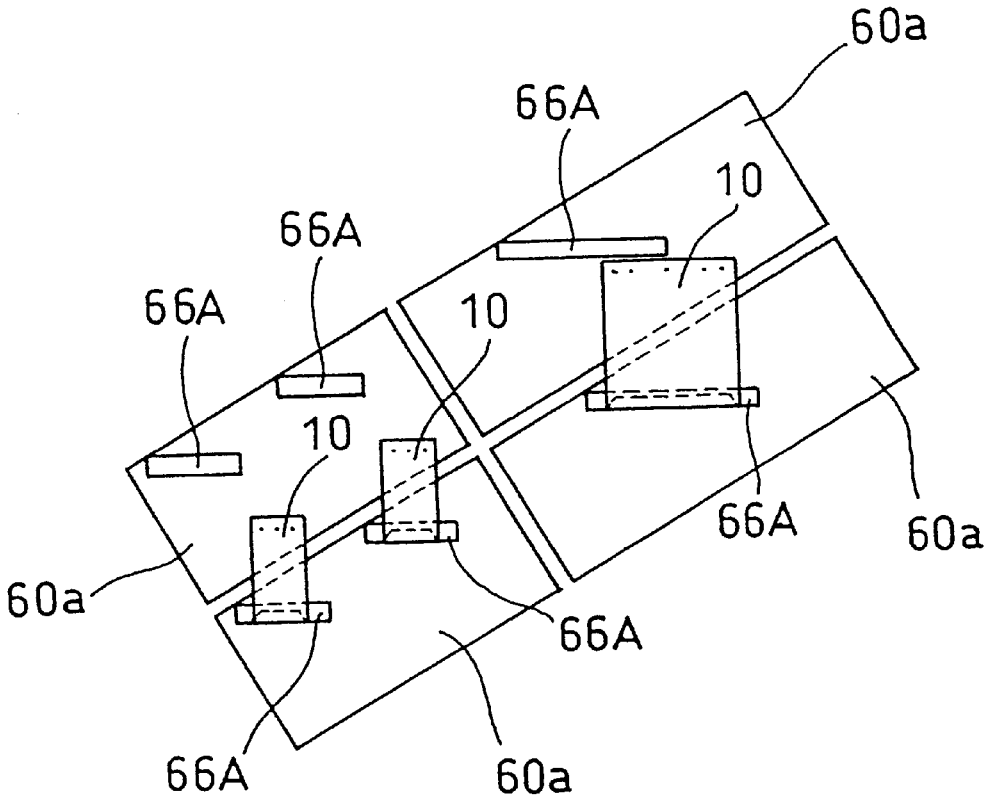
FIG. 8 is a rear view schematically illustrating another embodiment of a building wall that has been constructed by a method of attaching siding boards according to the present invention.
Figure 9:
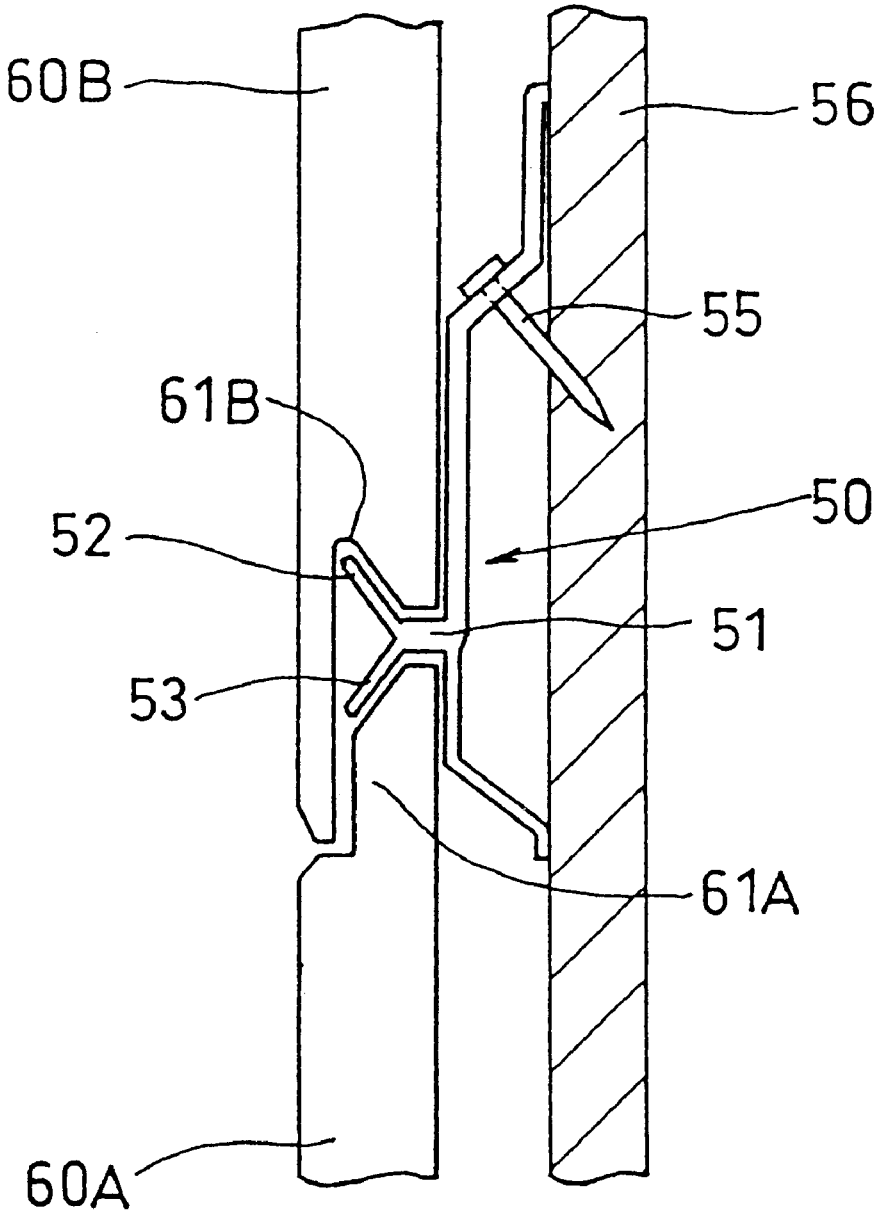
FIG.9 (PRIOR ART)
FIG. 9 is a cross-sectional view illustrating a state of siding boards that has been attached by making use of a fastening member according to the prior art.

FIG. 8 illustrates a schematic view of another example of the back surface of a building wall which has been constructed using a method of attaching siding boards according to the present invention, wherein square siding boards 60*a* are attached to a building frame in an oblique pattern. As shown in FIG. 8, engaging grooves 66A in this case are formed in each siding board at an angle which is not parallel nor orthogonally intersected with the four sides of the siding board, and are designed to be engaged with the hook portion of the suspender 10. In this case also, a siding board 60 of any desired size can be easily attached to the building frame at any desired angle (i.e. at any desired angle formed between the sides of siding board and the engaging groove 66A) as long as a place for horizontally fixing the suspender 10 can be secured in the building frame. As a result, it is now possible to construct a building wall which is novel and rich in design.

In the foregoing explanation, the present invention has been explained with reference to preferable examples. However, there are many other possible modifications. For example, the suspender 10 shown in FIG. 4A is explained as being designed such that a couple of them are required for hanging one piece of siding board 60. However, if a suspender having a larger width is employed, it may be possible to satisfactorily support a piece of siding board 60 using only one piece of suspender. Further, in the foregoing explanation, a siding board provided with a recessed portion 64 in the back surface thereof has been illustrated. However, although it is not shown in the drawing, it is also possible according to the present invention to employ a siding board whose back surface is entirely flat. In this case, an engaging groove for allowing the hook portion of the suspender to be fitted therein may be directly formed in the flat back surface of the siding board. A modified suspender supports the flat siding board. The modified suspender has a configuration similar to the suspenders shown in FIGS. 4A, 4B or 5 except that the bottom plates 12, or 12*a* and 12*b*, are deleted so that hook portions 13, or 13*a* and 13*b* extend directly from the respective lower ends of substrate 11, or 11*a* and 11*b* respectively. Further, a siding board having a rectangular (square) configuration has been shown in the drawings. However, there is not any particular limitation regarding the external shape of the siding board, i.e. the external shape of the siding board may be selected in any desirable manner.

Since the siding board is suspended from the building frame by its own dead weight, the attached state of the siding boards can be extremely stabilized and hence the siding boards tend not to fall away from the building frame even if the siding boards are caused to vibrate due to an earthquake, etc.

Further, it is possible to perform the construction of building wall of large area within a shorter period of time as compared with the conventional construction method. It is also possible to apply the present invention to a construction employing a stone material or a large ceramic plate.

Furthermore, it is also possible to attach the siding boards to a building frame, leaving a space of any desired width (horizontal joint) between an upper and lower siding boards, thus rendering the relatively thick sidewall surface of the siding board visible to provide a wall surface having an enhanced design quality.

Additionally, since a siding board can be attached to a building frame independent of neighboring siding boards, it is possible to attach siding boards to or detach siding boards from a building frame, so that even when a siding board is damaged, only the damaged siding board can be easily replaced by a new siding board.

Since the engaging groove for the suspension of the siding board is required to be formed only on the back surface of the siding board, the groove-forming work for forming an engaging groove on the four sides or cross-sections of siding board is eliminated. Therefore, any desired design (pattern) can be applied to all of peripheral sides of the siding board, thereby making it possible to easily present a horizontal joint having a high-grade feeling.

What is claimed is:

1. A method of attaching siding boards to a building frame which comprises the steps of:

fixing a suspender to said building frame, said suspender having a hook portion; and attaching a siding board provided with an engaging groove, integrally formed in a recessed portion extending structurally from and into a back surface of the board wherein said recessed portion and engaging groove extend into said board from said back surface, to said suspender by permitting said engaging groove to engage said hook portion of said suspender, thereby attaching the siding board to the building frame while maintaining the siding board in a suspended state.

2. A siding board structure comprising in combination:

a plurality of suspenders each having a hook portion and which are adapted to be fixed to a building frame; and a plurality of said siding boards each provided which an engaging groove, formed in a recessed portion in a back surface of the board wherein said recessed portion and engaging groove extend into said board from said back surface, for engaging said hook portion of a respective one of the suspenders, for attaching said siding boards to a building frame in a suspended state.

3. A method of attaching siding boards to a building frame while maintaining the siding boards in a suspended state, said method comprising the steps of:

fixing a suspender to said building frame; and attaching a siding board provided with an engaging groove to said suspender by permitting said engaging groove of siding board to engage said suspender, wherein said siding board is provided on the back surface thereof with a recessed portion having an engaging groove at an upper edge of said recessed portion, said engaging groove being sized and arranged to receive an engaging portion of said suspender, said engaging groove extending along approximately an entire width of said upper edge, and wherein said suspender is formed from a metal plate, said metal plate including a substrate, a bottom plate extended forward from the lower end of the substrate, and said engaging portion extending obliquely upward from a distal end of the bottom plate, an extending length and an inclined angle of said bottom plate being approximately identical with a width in a depthwise direction and an inclined angle of said upper edge of the recessed portion formed on the back surface of the siding board, and an extending length and an inclined angle of said engaging portion enabling said engaging portion to be fitted in said engaging groove formed on the back surface of said siding board.

4. A siding board structure comprising in combination:

a plurality of suspenders each having an engaging portion and which are adapted to be fixed to a building frame; and a plurality of siding boards each provided on the back surface thereof with an engaging groove for engaging with said engaging portion of a respective one of the suspenders, for maintaining said siding boards in a suspended state, wherein each of said siding boards is provided on the back surface thereof with a recessed portion having an engaging groove at an upper edge of said recessed portion, said engaging groove being designed to permit said engaging portion of one of the suspenders to be fitted therein, said engaging groove extending along approximately an entire width of said upper edge, and wherein each of said suspenders is formed from a metal plate, said metal plate including a substrate, a bottom plate extended forward from the lower end of the substrate, and a hook portion being said engaging portion extending obliquely upward form the distal end of the bottom plate, an extending length and an inclined angle of said bottom plate being approximately identical with a width in a depthwise direction and a inclined angle of said upper edge of the recessed portion formed on the back surface of the siding broad, and an extending length and an inclined angle of said hook portion being sized and arranged to enable said hook portion to be fitted in said engaging groove formed on the back surface of said siding board.

5. A siding board structure comprising in combination:

a building frame;

a plurality of suspenders each having a hook portion being fixed to the building frame; and a plurality of siding boards each provided with an engaging groove formed in a recessed portion in a back surface of the board wherein said recessed portion and engaging groove extended into said board from said back surface for engaging said hook portion of a respective one of the suspenders to thereby attach said siding boards to the building frame in a suspended state.

6. The siding board structure according to claim 5, wherein said siding boards are attached in said suspended state and in a multi-stage pattern to the building frame wherein the siding boards of neighboring stages are spaced apart to such an extent that sidewall surfaces of upper and lower siding boards are visible.

7. A siding board structure comprising in combination:

a building frame;

a plurality of suspenders each having a hook portion being fixed to the building frame; and a plurality of siding boards each provided on the back surface thereof with an engaging groove for engaging with said engaging portion of a respective one of the suspenders, thereby maintaining said siding boards in a suspended state, wherein each of the siding boards is provided on the back surface thereof with a recessed portion having an engaging groove at an upper edge of said recessed portion, said engaging groove being designed to permit said engaging portion of one of the suspenders to be fitted therein, said engaging groove extending along approximately an entire width of said upper edge, and wherein each of said suspenders is formed from a metal plate, said metal plate including a substrate, a bottom plate extending forward from the lower end of the substrate, and a hook portion extending obliquely upward from the distal end of the bottom plate, an extending length and an inclined angle of said bottom plate being approximately identical with a width in a depthwise direction and an inclined angle of said upper edge of the recessed portion formed on the back surface of the siding board, and an extending length and an inclined angle of said hook portion being sized and arranged to enable said hook portion to be fitted in said engaging groove formed on the back surface of said siding board.

8. The siding board structure according to claim 7, wherein said siding boards are attached in a suspended state and in a multi-stage pattern to the building frame wherein the siding boards of neighboring stages are spaced apart to such an extent that sidewall surfaces of upper and lower siding boards are made visible.

9. The siding board structure according to claim 8, wherein at least one of said siding boards has a cut portion on a predetermined portion of the back surface thereof which is to be contacted with the substrate of one of said suspenders as said siding boards are being suspended and attached in large numbers to the building frame with said engaging groove being engaged with said hook portion of the suspender, thereby maintaining said siding boards in a suspended state.

10. The siding board structure according to claim 7, wherein at least one said suspender comprises a couple of said substrates being integrally attached to opposing sides of a horizontal member, each of said couple of said substrate including a bottom plate and a hook portion extending from the substrate, said horizontal member being integrally provided with a bent portion (16) being bent horizontally and extended in the same direction as that of the substrates, wherein said siding boards are attached to the building frame with said engaging groove being engaged with said hook portion of the suspender, thereby maintaining said siding boards in a suspended state.

11. The siding board structure according to claim 6, wherein at least one said suspender comprises a couple of said substrates being integrally attached to opposing sides of a horizontal member, each of said couple of said substrates including a bottom plate and a hook portion extending from the substrate, said horizontal member being integrally provided with a bent portion (16) being bent horizontally and extended in the same direction as that of the substrates, wherein said siding boards are attached to the building frame with said engaging groove being engaged with said hook portion of the suspender, thereby maintaining said siding boards in a suspended state.

* * * * *